US006547041B2

(12) United States Patent
Carlsson

(10) Patent No.: US 6,547,041 B2
(45) Date of Patent: Apr. 15, 2003

(54) LIFTING DEVICE FOR A COUNTERWEIGHT LIFT TRUCK

(75) Inventor: Hans Åke Ulf Carlsson, Villagatan (SE)

(73) Assignee: SMV Lifttrucks AB, Markaryd (SE)

( * ) Notice: Subject to any disclaimer, the term of this patent is extended or adjusted under 35 U.S.C. 154(b) by 0 days.

(21) Appl. No.: 09/798,462

(22) Filed: Mar. 3, 2001

(65) Prior Publication Data

US 2001/0018994 A1 Sep. 6, 2001

(30) Foreign Application Priority Data

Mar. 3, 2000 (SE) ..... 0000700

(51) Int. Cl.[7] ..... B66F 9/14

(52) U.S. Cl. ..... 187/227; 187/222; 414/631

(58) Field of Search ..... 187/222, 226, 187/227, 228, 248; 180/89.12; 296/190.01; 414/667, 631

(56) References Cited

U.S. PATENT DOCUMENTS

| | | | | | |
|---|---|---|---|---|---|
| 2,339,120 | A | * | 1/1944 | Ulinski | 187/226 |
| 4,030,568 | A | * | 6/1977 | Heinold | 187/227 |
| 4,069,932 | A | | 1/1978 | Stedman | 187/226 |
| 4,392,669 | A | * | 7/1983 | Martin, Jr. | 180/89.12 |
| 4,441,585 | A | * | 4/1984 | Macnab | 187/227 |
| 4,531,615 | A | * | 7/1985 | Wible | 187/227 |
| 4,657,471 | A | * | 4/1987 | Shinoda et al. | 187/226 |
| 4,921,075 | A | * | 5/1990 | Schumacher et al. | 187/229 |
| 4,949,816 | A | * | 8/1990 | Brown et al. | 187/227 |
| 5,000,293 | A | | 3/1991 | Brown et al. | 187/227 |
| 5,286,081 | A | * | 2/1994 | Martin, Jr. | 180/89.12 |
| 5,641,261 | A | * | 6/1997 | Talbert et al. | 187/226 |
| 5,879,124 | A | * | 3/1999 | Brouwer et al. | 180/209 |
| 6,241,454 | B1 | * | 6/2001 | Ruf | 187/227 |

FOREIGN PATENT DOCUMENTS

| | | | | |
|---|---|---|---|---|
| JP | 403120199 | * | 5/1991 | 187/227 |
| JP | 405338998 | * | 12/1993 | 187/227 |

* cited by examiner

*Primary Examiner*—Eileen D. Lillis
*Assistant Examiner*—Paul T. Chin
(74) *Attorney, Agent, or Firm*—Tarolli, Sundheim, Covell & Tummino L.L.P.

(57) ABSTRACT

The present invention relates to a device at counterweight lift trucks (1) for giving the operator a substantially free field of view in the driving direction (F). A lifting device (11) comprises a vertically movable frame (13) which is mounted on a fixed frame (12) and which includes a lifting carriage (14). The counterweight lift truck (1) comprises an operator's cabin (9) with a seat (10) for the operator. The frames (12, 13) are, seen in the driving direction (F), located behind a vertical plane (A) which is transverse relative to the driving direction (F) and in which front wheels (3, 4) of the counterweight lift truck (1) are situated. The frames (12, 13) lack transverse beams beneath upper transverse beams (18, 21). The operator's cabin (9) is located immediately behind the frames (12, 13) and there are support devices which replace transverse beams beneath the upper transverse frame beams (18, 21).

23 Claims, 4 Drawing Sheets

LIFTING DEVICE FOR A COUNTERWEIGHT LIFT TRUCK

BACKGROUND OF THE INVENTION

The present invention relates to a device for a counterweight lift truck for giving the truck operator a substantially free field of view in the driving direction. The counterweight lift truck comprises a chassis with, seen in the driving direction, front and rear driving wheels, a rearwardly mounted counterweight device, at least one driving motor and an operator's cabin with an operator's seat on which the operator is sitting during driving of the counterweight lift truck and during operation of a lifting device mounted on said truck. The lifting device includes a frame which is fixedly mounted on the chassis, a vertically moveable frame which is mounted on the fixedly mounted frame which is mounted on the fixedly mounted frame and a vertically movable lifting carriage which is mounted on the movable frame and which has one or more lifting means for lifting goods. The fixedly and movably mounted frames each include substantially vertically mounted frame beams and, relative to the driving direction, transverse frame beams which are located between the substantially vertically mounted frame beams and on a level above the operator's cabin.

A lifting unit is mounted on the fixed frame for lifting the movable frame. The counterweight lift truck comprises, as stated, an operator's cabin with a seat for the operator.

In known counterweight lift trucks of this type, the operator's field of view in the driving direction is considerably limited by the frames of the lifting device because these are located far in front of the operator's cabin. Furthermore, the frames and the lifting carriage have transverse frame beams which during driving and lifting operations normally are located in level with the operator's cabin and thereby directly block large parts of the field of view right in front of the operator.

In counterweight lift trucks with an operator's cabin, the problem with a poor field of view for the operator has not yet been eliminated despite the fact that the problem is particularly great in such lift trucks because of their very large and voluminous frames.

However, measures for improving the view have been taken in lift trucks of smaller types as illustrated in the publication U.S. Pat. No. 5,000,293 and U.S. Pat. No. 4,069,932. In the lift truck of U.S. Pat. No. 5,000,293, the vertical beams of the frame have been inclined in order to give the operator a large field of view. Such locations of the vertical beams of the frame may certainly give the operator a larger field of view, but the construction is complex and expensive. The lift truck of U.S. Pat. No. 4,069,932 has no operator's cabin and the operator's seat is located so far behind the frames that these considerably limit the operator's field of view.

SUMMARY OF THE INVENTION

The object of the present invention has been to provide a device which eliminates this problem while maintaining the stability of the lifting device. This is arrived at by providing the device with the characterizing features of subsequent claim 1.

Since the device is provided with the characterizing features, the operator gets a large substantially free field of view than previously when he sits on his seat in the operator's cabin. Hereby, the operator can work quicker and safer from his seat in the operator's cabin and his work becomes less tiring and the risk for injuries is smaller. Also, the counterweight lift truck gets a smaller total length, a better weight distribution and the lifting device can protect the operator's cabin against goods falling down from above.

BRIEF DESCRIPTION OF THE DRAWINGS

The invention will be further described below with reference to the accompanying drawings, in which.

DETAILED DESCRIPTION OF THE INVENTION

Figure 1:
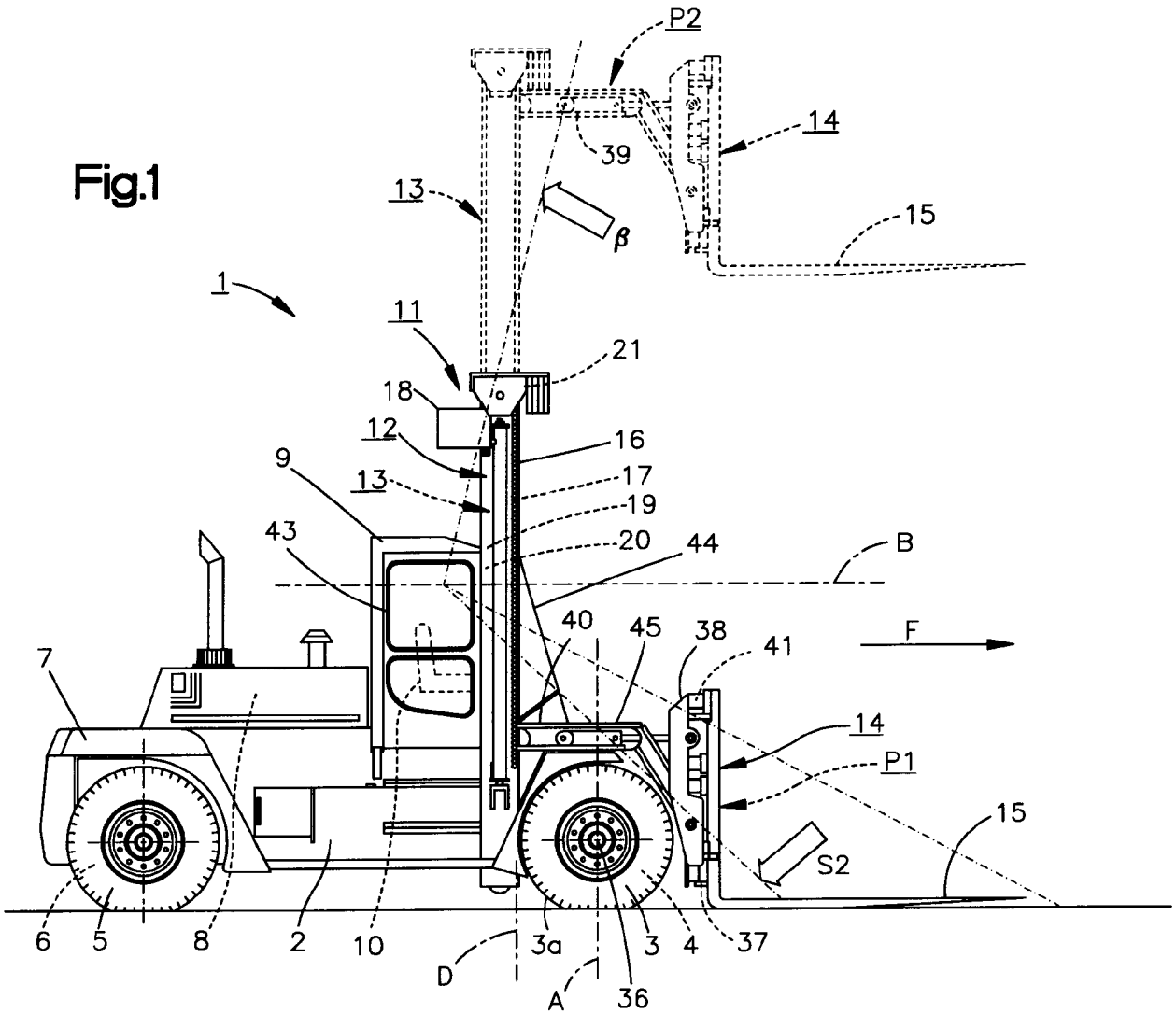
FIG. 1 is a side view of a counterweight lift truck having a device according to the invention.
Figure 2:
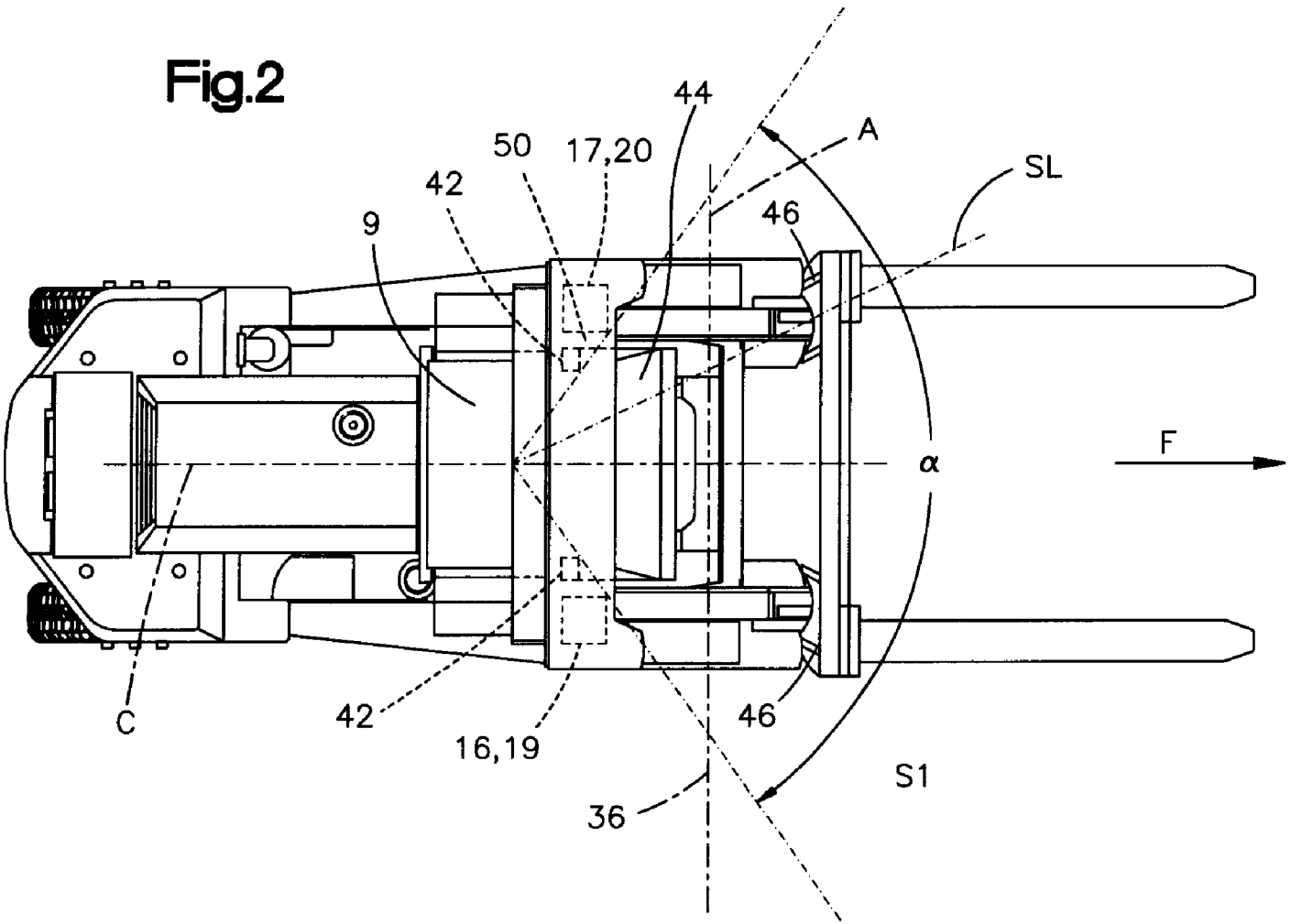
FIG. 2 is a plan view of the counterweight lift truck of FIG. 1.
Figure 3:
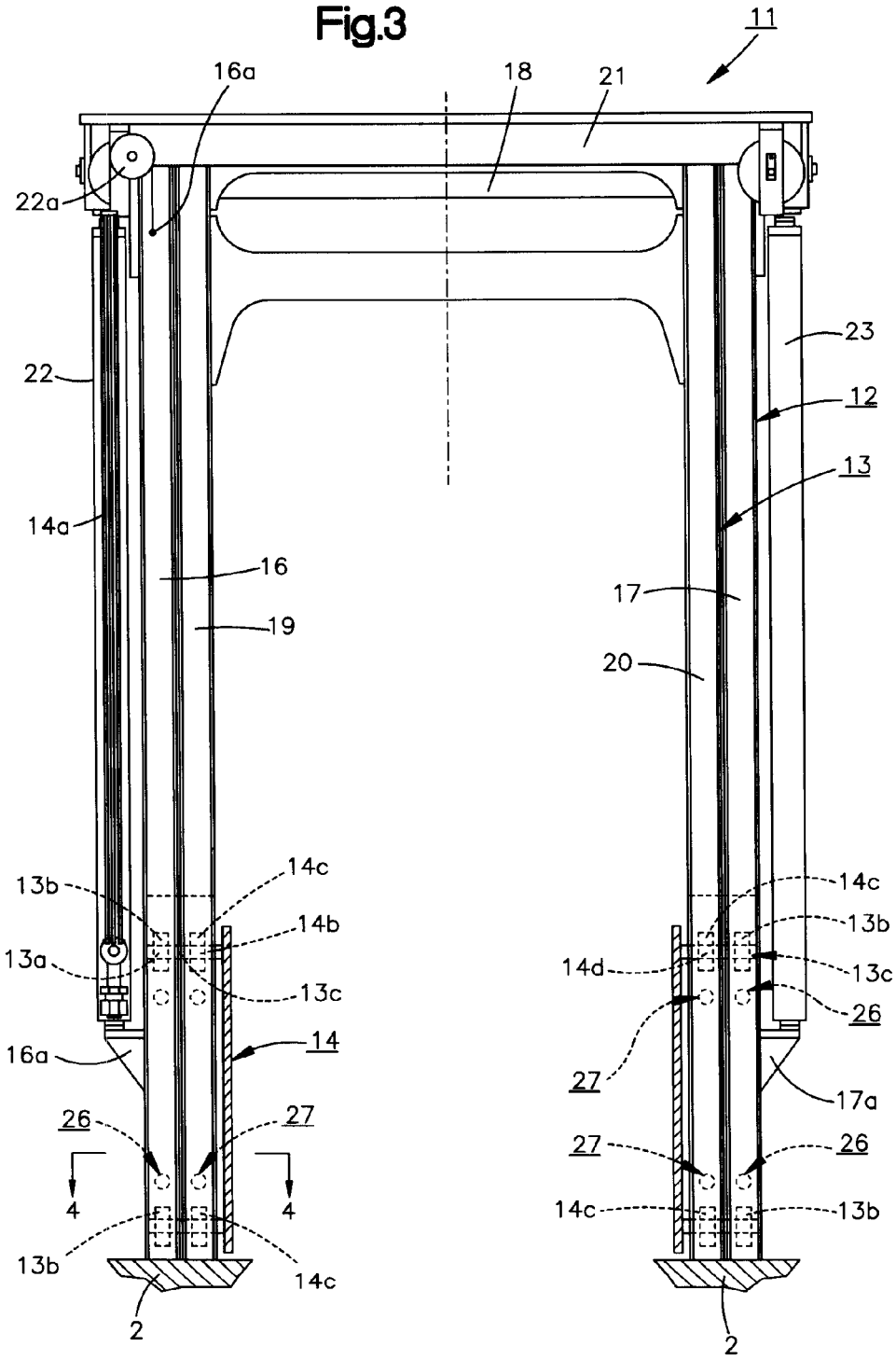
FIG. 3 illustrates the frames forming part of the counterweight lift truck of FIG. 1.
Figure 4:
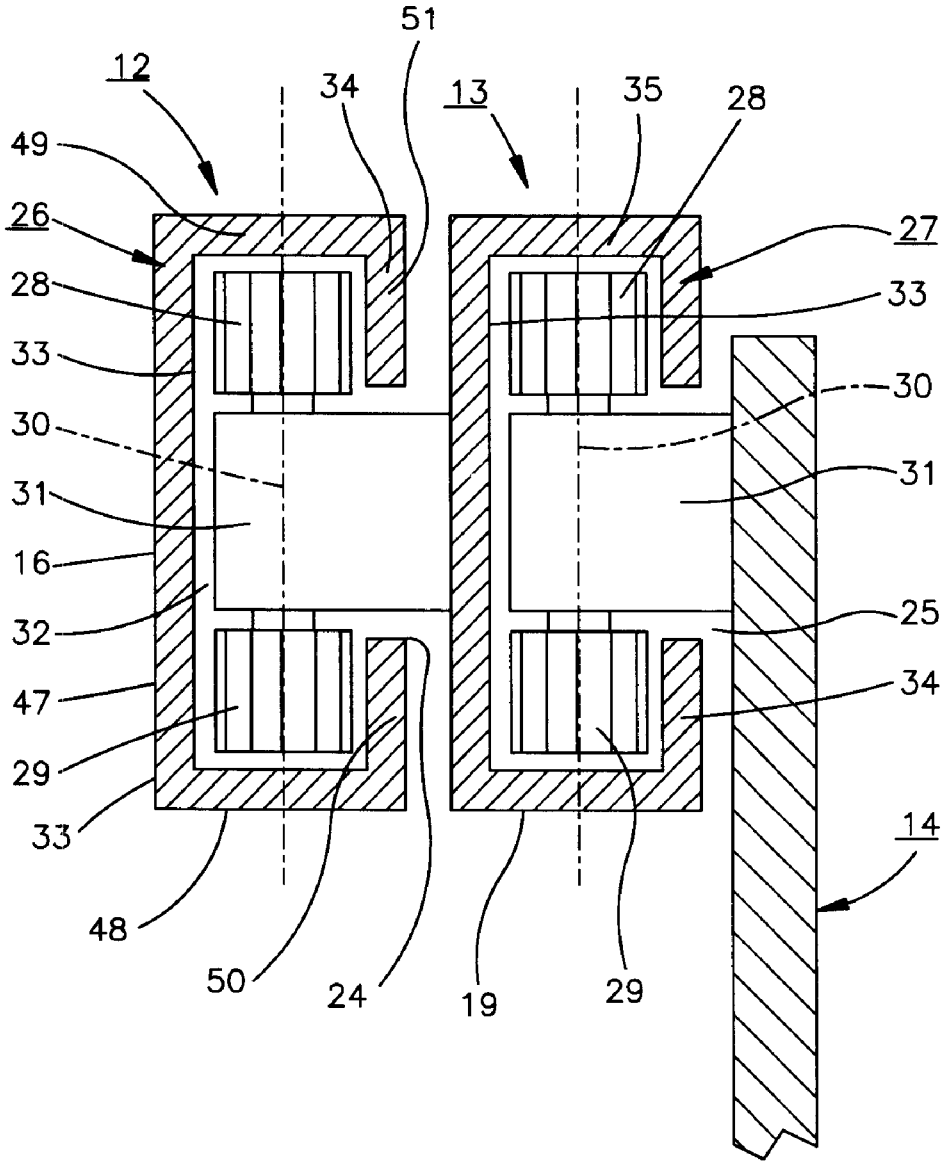
FIG. 4 is a section IV—IV in FIG. 3 and illustrates support devices forming part of the counterweight lift truck of FIG. 1.

The drawing illustrates a counterweight lift truck 1 in the form of a fork lift truck. It comprises a chassis 2 with, seen in the driving direction F, front driving wheels 3, 4 and rear driving wheels 5, 6. At the rear of the chassis 2 there is provided a counterweight device 7. On the chassis 2 there is also provided at least one driving motor 8 for operating at least some of the driving wheels 3–6 and an operator's cabin 9 with an operator's seat 10 on which the operator is sitting during driving of the counterweight lift truck 1 and during operation of a lifting device 11 mounted on the truck 1.

The lifting device 11 includes a frame 12 which is fixedly mounted on the chassis 2 and a frame which is moveably or displaceably mounted on the fixed frame 12 and which preferably is located within said fixed frame. The lifting device 11 further includes a lifting carriage 14 which is vertically displaceably mounted on the movable frame 13 and which has one or more lifting means 15 for lifting goods. At the embodiment shown, the lifting carriage 14 is a for carriage and the lifting means forks are directed forward in the driving direction F.

The statement that the frames 12, 13 and their frame beams 16, 17 and 19, 20 are vertical is considered to include also that they are somewhat inclined and/or twisted relative to the vertical plane.

The fixedly mounted frame 12 has two vertically arranged frame beams 16 and 17 which on a level above the operator's cabin 9 are connected to each other by means of an upper frame beam 18 which is transverse relative to the driving direction F. The movably mounted frame 13 has two vertically arranged frame beams 19 and 20 which on a level above the operator's cabin 9 are connected to each other by means of an upper frame beam 21 which is transverse relative to the driving direction.

The movable frame 13 is lifted relative to the fixed frame 12 by means of a lifting unit, preferably including two lifting cylinders 22, 23 which down below are attached to the frame beams 16 and 17 respectively, through brackets 16*a* and 17*a* respectively. The lifting carriage 14 is located on the lower end of a chain 14a which at the top runs over a guide roll 22*a* at the top of the cylinder 22. Since the upper end of the chain 14a is fixedly attached to the frame beam 16 of the fixed frame 12 at a mounting point 16*a*, the lifting carriage 14 will move upwards twice the distance the movable frame 13 is lifted by the lifting cylinders 22, 23.

When the movable frame 13 is lifted or raised from its lower position to its upper position (broken lines in FIG. 1), the lifting carriage 14 has been lifted or raised from its lower position P1 at the floor to its upper position P2 at the upper parts of the movable frame 13.

The fixed frame 12 lacks transverse beams between the chassis 2 on which it is mounted and its upper transverse frame beam 18. The movable frame 13 lacks transverse beams beneath its upper frame beam 21.

The vertical frame beams 16, 17 of the fixed frame 12 are substantially U-shaped and have their open sides 24 facing inwards. The vertical frame beams 19, 20 of the movable frame 13 are located close within the vertical frame beams 16, 17 of the fixed frame 12 such that one beam 16 of the fixed frame and one beam 19 of the movable frame define a frame-beam pair and another beam 17 of the fixed frame and another beam 20 of the movable frame define another frame-beam pair. The vertical frame beams 19, 20 of the movable frame 13 are also substantially U-shaped and have their open sides 25 directed inwards.

The frame beams 16, 17 and 19, 20 of the fixed and the movable frame 12, 13 thus have a substantially U-shaped cross section, whereby webs or web members 47 of the frame beams 16, 17, 19, 20 are provided in parallel with the driving direction F and shanks 48, 49 extending from said web members 47 define a right angle with the driving direction F and are directed inwards towards central parts of the counterweight lift truck 1. The shanks 48, 49 of the frame beams 16, 17, 19, 20 have flanges 50, 51 which are directed towards each other and define the open sides 24, 25.

Of eight support devices 26, 27, four support devices 26 are provided to replace those transverse beams (not shown) which previously were provided on the frames 12, 13 beneath their upper transverse frame beams 18, 21 and on the lifting carriage 14 and which were adapted to give the frames 12, 13 the required stability in transverse directions relative to the driving direction F, but which also have limited the operator's field of view in the driving direction F. The four other support devices 27 are provided to replace such a transverse frame beam (not shown) on the lifting carriage 14 which previously was located close to the frames 12, 13. The four support devices 26 are mounted on the movable frame 13 and cooperate with the fixed frame 12 so that said fixed frame carries such loads on the movable frame 13 which are directed substantially sideways relative to the driving direction F. The four other support devices 27 are mounted on the lifting carriage 14 and cooperate with the movable frame 13 so that said movable frame and, through its support devices 26, the fixed frame 12 carry such loads on the lifting carriage 14 which are directed substantially sideways in relation to the driving direction F.

Each support device 26, 27 has two support rolls 28, 29 which are journalled to rotate about an axis 30 which is parallel to or substantially parallel to the driving direction F. The support rolls 28, 29 are mounted on a bracket 31 such that they are positioned on opposite sides thereof.

Such a bracket 31 is fixedly secured to each vertical frame beam of the movable frame 13, it is transversally provided relative to the driving direction F, it extends through the open sides 24 of the vertical frame beams 16, 17 of the fixed frame 12 and into vertical grooves 32 formed thereby, and it keeps the support rolls 28, 29 in each groove 32 located between two support surfaces 33, 34 on the frame beams 16, 17 such that the support rolls 28, 29 are supported by the support surfaces 33, 34 and can roll thereon.

Another bracket 31 of said type is fixedly mounted on opposite sides of the lifting carriage 14, it is also transversally located relative to the driving direction F, it extends through the open sides 25 of the vertical frame beams 19, 20 of the movable frame 13 and into vertical grooves 35 defined thereby and keeps the support rolls 28, 29 in each such groove located between two support surfaces 33, 34 on the frame beams 19, 20 such that the support rolls 28, 29 are supported by said support surfaces 33, 34 and can roll thereon.

Four of said support devices 26, 27 are located on one level, while four other of said support devices are found on another level. On each frame beam 19, 20 of the movable frame 13 there are mounted brackets **13*a* with two frame rolls 13*b*. These rotate about axes 13*d* which are transverse relative to the driving direction F and they are located in the vertical groove 32 in the frame beams 16, 17 of the fixed frame 12. The frame rolls 13*b* can roll and engage the frame beams 16, 17 and they are adapted to guide the movable frame 13 relative to the fixed frame 12 and provide support for the movable frame 13 relative to the fixed frame 12** in a direction which is substantially parallel with the driving direction F.

Brackets **14*b* with two frame rolls 14*c* are provided on the lifting carriage 14. Said rolls 14*c* rotate about axes 14*d* which are transverse relative to the driving direction F and they are located in the vertical groove 35 in the frame beams 19, 20 of the movable frame 13. The frame rolls 14*c* can roll and get support from the frame beams 19, 20 and they are adapted to guide the lifting carriage 14 relative to the movable frame 13** and provide support for the lifting carriage relative to the movable frame in a direction which is substantially parallel with the driving direction F.

The fixed frame 12 as well as the movable frame 13 lack, beneath their transverse upper frame beams 18 and 21 respectively, such transverse beams which can limit the operator's field of view in the driving direction F.

At least substantial parts of the operator's cabin 9 are, seen in the driving direction F of the counterweight lift truck 1, located immediately behind the frames 12, 13 such that the operator's seat 10 in the cabin 9 is found close to said frames 12, 13. Preferably, front members 44 of the operator's cabin 9 are, seen in the driving direction F of the counterweight lift truck 1, located between the frames 12, 13. Said front members 44 may extend past the frames 12, 13 and terminate somewhat in front thereof.

Seen in the driving direction F, the vertical frame beams 16, 17 and 19, 20 of the fixed and the movable frame 12 and 13 respectively, are located in or behind a vertical plane A which is transverse relative to the driving direction F and in which axes of rotation 36 for the front wheels 3, 4 are situated, namely so that the operator between the frame-beam pairs 16, 19 and 17, 20 gets a field of view S1 which is free in the driving direction F and substantially in the horizontal plane B and which has an angle $\alpha$ of 90–130°, preferably about 110°. The vertical frame beams 16, 17 and 19, 20 of the fixed and the movable frame 12, 13 may preferably, seen in the driving direction F, be located immediately behind a vertical plane D which is transverse relative to the driving direction F and which is found just behind the wheel periphery of the front wheels 3, 4.

Seen in the driving direction F, the vertical frame beams 16, 17 and 19, 20 of the fixed and the movable frame 12, 13 may be located just in front of a side door 43 to the operator's cabin 9 such that said vertical frame beams 16, 17, 19 and 20 permit passage of the operator into and out of said cabin 9 through the side door 43 without problem. As is apparent from FIG. 1, front members 44 of the operator's cabin 9 may, seen in the driving direction F, be located in front of the vertical frame beams 16, 17 and 19, 20 of the fixed and the movable frame 12, 13. As is also apparent from FIG. 1, the transverse upper frame beams 18, 21 of the fixed and the movable frame 12, 13 are located above the front members 44 of the operator's cabin 9 and protect thereby the cabin against goods which fall down towards said cabin.

The lifting carriage 14 is preferably designed and the transverse upper frame beams 18, 21 are preferably provided such that the operator, when he is sitting on his seat 10, gets a field of view S2 in the driving direction F and substantially in a vertical plane C in parallel with the driving direction F which down below is limited by a lower transverse frame beam 37 on a front member 38 of the lifting carriage 14 when said carriage is situated in its lower position P1. The field of view S2 is at the top limited by the upper transverse frame beam 18 of the fixed frame 12. The angle β of this field of view S2 is 100–130°, preferably about 120°.

If the lifting carriage 14 is designed as a fork carriage, the lower frame beam 37 mounted on the front member 38 thereof and an upper transverse frame beam 41 also mounted on said front member 38, can be located relative to each other such that the operator, when he is sitting on his seat 10, can see the tips or points of the forks 15 when the fork carriage is in its lower position P1.

The operator's cabin 9 may have front corner posts 42 which conceal-a part SO of the operator's view when he is sitting on the operator's seat 10. The vertical frame beams 16, 17, 19, 20 of the fixed and the movable frame 12, 13 can be located relative to these corner posts 42 such that they at least partially are situated within the part SO of the operator's view concealed by said corner posts 42.

The front member 38 of the lifting carriage 14 is, seen in the driving direction F, located in front of the front driving wheels 3, 4 and its rear member 40 is preferably located behind said wheels 3, 4. The lifting carriage 14 is through its rear member 40 mounted on the movable frame 13 and the front and rear members 38, 40 are connected with each other through connecting members 45 which are located on a level above the front driving wheels 3, 4. The connecting members 45 may, at a distance from the rear members 38, include a transverse stay 39 which is so thin that it does not essentially limit the operator's view.

The front members 38 of the lifting carriage 14 also have vertically directed frame beams 46 which connect the lower and upper frame beams 37, 41. These vertically directed frame beams 46 can be located in such an inclined position relative to the driving direction F that they lie substantially in parallel with a line of aim SL from the operator when he is sitting on the operator's seat 10 in a direction obliquely forward in the driving direction F.

The invention is not limited to what is described above and illustrated in the drawings, but its construction may vary within the scope of the subsequent claims. Thus, the counterweight lift truck 1 may be another lift truck than a fork lift truck; the lifting carriage 14 may be of another type than a fork carriage; the lifting means 15 may be other means than forks; the support devices 26, 27 may be more than eight and may be of another type than those described and support devices 26, 27 may instead of on the movable frame 13 be provided on the fixed frame 12 and instead of on the lifting carriage 14 be provided on the movable frame 13. Finally, it should be mentioned that the operator's field of view may have other angles than those stated.

What is claimed is:

1. A counterweight lift truck for providing a truck operator a field of view in the driving direction (F) which is substantially unobstructed by the truck, the truck (1) comprising:

a chassis (2) with, as seen by the operator in the driving direction (F), front and rear driving wheels (3–6), a rearward mounted counterweight device (7), at least one driving motor (8), a lifting device (11) mounted on a said truck, and an operator's cabin (9) with an operator's seat (10) on which the operator sits during driving of the truck (1) and during operation of the lifting device (11), the lifting device (11) including a frame (12) fixedly mounted on the chassis (2), a vertically movable frame (13) mounted to the fixedly mounted frame (12) and a vertically movable lifting carriage mounted to the movable frame (13) the lifting carriage having one or more lifting means (15) for lifting goods, the fixed and movable frames (12 and 13) including substantially vertically mounted frame beams (16, 17 and 19, 20 respectively) and upper frame beams (18 and 21 respectively) located in a transverse direction to the vertically mounted frame beams and which connect together the substantially vertically mounted frame beams (16, 17 and 19, 20 respectively) at a distance above the operator's cabin (9), a lifting unit (22, 23) mounted on the fixed frame (12) for lifting the movable frame (13), the movable frame (13) being located within the fixed frame (12) such that the vertical frame beams (19, 20) of said movable frame (13) are located close to and within the vertical frame beams (16, 17) of said fixed frame (12), and first support devices (26) located on a level beneath said upper frame beams (18 and 21 respectively) such that the fixed frame (12) provides support for the movable frame (13) for moving in a direction transverse to the driving direction (F), and second support devices (27) located on a level beneath said upper frame beams (18 and/or 21) such that the movable frame (13) provides support for the lifting carriage (14) for lifting in said direction transverse to the driving direction (F), the fixed and the movable frames (12, 13), when viewed in the driving direction (F) of the truck (1), are located in or behind a vertical plane (A) which is transverse relative to the driving direction (F) and in which axes of rotation (36) for the front wheels (3,4) are situated, the fixed frame (12) as well as the movable frame (13) beneath their transverse upper frame beams (18 and 21 respectively) lack such transverse beams which can limit the operator's field of view in the driving direction (F), at least substantial parts of the operator's cabin (9), when viewed in the driving direction (F) of the truck (1), are provided just behind the frames (12, 13) so that the seat (10) in the operator's cabin (9), in the driving direction, is situated adjacent said frames (12, 13), the vertical frame beams (16, 17) of the fixed frame (12) have open sides (24) facing inwards and include vertical grooves (32) with support surfaces (33, 34), at least one of said first support devices (26) is provided between each vertically mounted frame beam (16, 17) of the fixed frame (12) and a vertically mounted frame beam (19, 20) of the movable frame (13) within said frame beam (16, 17), said at least one of said first support devices including brackets (31), which a) are provided on the vertical frame beams (19, 20) of the movable frame (13), b) extend through the open sides (24) of the vertical frame beams (16, 17) of the fixed frame (12) and into the vertical grooves (32), and c) have support rolls (28, 29) which cooperate with the support surfaces (33, 34) on the vertical grooves (32) of the fixed frame (12), the vertical frame beams (19, 20) of the movable frame (13) have open sides (25) facing inwards and include vertical grooves (35) with support surfaces (33, 34), at least one of said second support devices (27) is provided between the lifting carriage (14) and each vertically mounted frame beam (19, 20) of the movable frame (13), and said at least one of said second support devices (27) including brackets (31), which a) are provided on the lifting carriage (14), b) extend through the open sides (25) of the vertical frame beams (19, 20) of the movable frame (13) and into vertical grooves (35), and c) have support rolls (28, 29) which cooperate with support surfaces (33, 34) on the vertical grooves (35) of the movable frame (13).

2. Device according to claim 1, characterized in that two frame-beam pairs (16, 19 and 17, 20) of the vertically directed frame beams (16, 17, 19, 20) of the fixed and movable frames (12, 13) are provided behind a vertical plane (A) such that the operator, when sitting on the seat (10), between said frame-beam pairs (16, 19 and 17, 20) and seen in a horizontal plane (B), gets a substantially free field of view (S1) in the driving direction (F) having a view angle ($\alpha$) spanning 90–130°.

3. Device according to claim 2, characterized in that the angle ($\alpha$) is about 110°.

4. Device according to claim 1, characterized in that the lifting carriage (14) is designed such that the operator, when sitting on the seat (10), seen in a vertical plane (C), gets a field of view (S2) in the driving direction (F) which down below is limited by a lower transverse frame beam (37) on a front member (38) of the lifting carriage (14) when said lifting carriage (14) is situated in a lower position (P1) and which at the top is limited by an upper, relative to the driving direction (F) transverse frame beam (18) of the fixed frame (12) and that an angle ($\beta$) of said field of view (S2) is 100–130°.

5. Device according to claim 4, characterized in that the angle ($\beta$) of said field of view (S2) is about 120°.

6. Device according to claim 1, wherein the lifting carriage (14) is designed as a fork carriage having forks which are directed forwards, seen in the driving direction (F), and which have a lower and an upper transverse frame beam (37, 41) relative to the driving direction (F), characterized in that the lower and upper transverse frame beams (37, 41) of the fork carriage (14) are located so that the operator, when sitting on the seat (10), can see points or tips of the forks (15) when the fork carriage (14) is situated in a lower position (P1).

7. Device according to claim 1, wherein the operator's cabin (9) includes front corner posts (42) which conceal a part (SO) of the operator's view obliquely forward in the driving direction (F) when the operator is sitting on the operator's seat (10), characterized in that the frame beams (16, 17, 19, 20) of the fixed and movable frames (12, 13) are located relative to the corner posts (42) such that they at least partly are situated within the part (SO) of the operator's view concealed by said corner posts (42).

8. Device according to claim 1, wherein the lifting carriage (14) comprises vertically mounted frame beams (46), characterized in that the vertically mounted frame beams (46) of the lifting carriage (14) are inclined relative to the driving direction (F) such that they are situated substantially in parallel with a line of aim (SL) from the operator when the operator is sitting on the operator's seat (10), in a direction obliquely forward in the driving direction (F).

9. Device according to claim 1, characterized in that front members (44) of the operator's cabin (9), seen in the driving direction (F) of the counterweight lift truck (1), are located between the frames (12, 13).

10. Device according to claim 1, characterized in that front members (44) of the operator's cabin (9), seen in the driving direction (F) of the counterweight lift truck (1), extend beyond the frames (12, 13).

11. Device according to claim 1, characterized in that the vertical frame beams (16, 17 and 19, 20) of the fixed and movable frames (12, 13) are, seen in the driving direction (F), located immediately behind a vertical plane (D) which is transverse relative to the driving direction (F) and which is located just behind the wheel periphery (3*a*) of the front wheels (3, 4).

12. Device according to claim 1, wherein the operator's cabin (9) includes at least one side door (43), characterized in that, seen in the driving direction (F), the vertically directed frame beams (16, 17 and 19, 20) of the fixed and movable frames (12, 13) are located just in front of the side door (43) such that the operator can pass into and out of the operator's cabin (9).

13. Device according to claim 1, characterized in that the upper transverse frame beams (18, 21) of the fixed and movable frames (12, 13) are located above front members (44) of the operator's cabin (9) such that they protect the cabin (9) against goods falling down.

14. Device according to claim 1, characterized in that at least one of said first support devices (26) is provided between each vertically mounted frame beam (16 and 17) of the fixed frame (12) and a vertically mounted frame beam (19 and 20) of the movable frame (13) within said first frame beam (16 and 17), and that at least one of said second support devices (27) is provided between the lifting carriage (14) and each vertically mounted frame beam (19 and 20) of the movable frame (13).

15. Device according to claim 1, characterized in that four support devices (26, 27) are provided on one level and four other support devices (26, 27) on another level spaced from the four support devices (26, 27) in the direction transverse to the forward driving direction (F).

16. Device according to claim 15, characterized in that each support roll (28, 29) is provided between and can roll on two support surfaces (33, 34) which are defined by the vertical frame beam (16 and/or 17) of the fixed frame (12) and the vertical frame beam (19 and/or 20) of the movable frame (13).

17. Device according to claim 1, characterized in that each of said first and second support devices (26, 27) has at least one support roll (28 and/or 29) which is rotatably mounted on an axis (30) which is located in parallel with the driving direction (F), that the support roll (28 and/or 29) in the first support device (26) of the movable frame (13) engages and can roll on support surfaces (33, 34) on the vertical frame beam (16 and/or 17) of the fixed frame (12) and that the support roll (28 and/or 29) in the second support device (27) of the lifting carriage (14) engages and can roll on support surfaces (33, 34) on the vertical frame beam (19 and/or 20) of the movable frame (13).

18. Device according to claim 17, characterized in that each support device (26, 27) comprises two support rolls (28, 29) which are rotatably mounted on a bracket (31) extending in a transverse direction relative to the driving direction (F) and which are located on opposite sides thereof, that the bracket (31) is directed into a vertical groove (35) in the vertical frame beams (16, 17 and 19, 20 respectively) of the fixed and the movable frame (12 and 13) respectively, and that each support roll (28, 29) is located between two support surfaces (33, 34) of the vertical frame beams (16, 17 and 19, 20 respectively) of the fixed and the movable frame (12, 13) respectively, such that it can engage and roll on said support surfaces (33, 34).

19. Device according to claim 1, characterized in that the substantially vertically mounted frame beams (16, 17 and 19, 20 respectively) of the fixed and the movable frame (12 and 13 respectively) have a substantially U-shaped cross section, whereby webs or web members (47) of the frame beams (16, 17, 19, 20) are located perpendicular to the driving direction (F) and shanks (48, 49) extending from said web members (47) define a right angle with the driving direction (F) and are directed inwards towards central parts of the truck (1).

20. Device according to claim 19, characterized in that the shanks (48, 49) of the frame beams (16, 17, 19, 20) have flanges (50, 51) which are directed towards each other and define open sides (24, 25) of said frame beams (16, 17, 19, 20).

21. (Twice Amended) Device according to claim 1, characterized in that the lifting unit comprises a lifting cylinder (22) which is provided on one of the vertically mounted frame beams (16) of the fixed frame (12), and that the lifting unit comprises another lifting cylinder (23) which is provided on the other vertically mounted frame beam (17) of said fixed frame (12).

22. Device according to claim 1, characterized in that the movable frame (13) is located within the fixed frame (12).

23. Device according to claim 1, characterized in that the lifting carriage (14) has a front member (38) which, seen in the driving direction (F), is located substantially in front of the front driving wheels (3, 4), that the lifting carriage (14) has a rear member (40), which, seen in the driving direction (F), is located substantially behind the axis of rotation (36) of front driving wheels (3, 4) and on the movable frame (13), and that the lifting carriage (14) further has connecting members (45) which connect said front and rear members (38, 40) with each other.

* * * * *